US007841541B2

(12) United States Patent
Ardelt et al.

(10) Patent No.: US 7,841,541 B2
(45) Date of Patent: Nov. 30, 2010

(54) FAN HAVING A SENSOR

(75) Inventors: Helmut Ardelt, VS-Villingen (DE); Rodica Peia, Zimmern ob Rottweil (DE)

(73) Assignee: EBM-Papst ST. Georgen GmbH & Co. KG, ST. Georgen (DE)

( * ) Notice: Subject to any disclaimer, the term of this patent is extended or adjusted under 35 U.S.C. 154(b) by 632 days.

(21) Appl. No.: 10/966,134

(22) Filed: Oct. 14, 2004

(65) Prior Publication Data

US 2005/0098641 A1 May 12, 2005

(30) Foreign Application Priority Data

Nov. 12, 2003 (DE) ..... 203 18 040 U
Aug. 7, 2004 (DE) ..... 20 2004 012 411 U

(51) Int. Cl.
*F24F 3/14* (2006.01)
*F25B 49/00* (2006.01)
*F04B 49/10* (2006.01)

(52) U.S. Cl. ..... 236/44 C; 62/176.6; 62/129; 417/32

(58) Field of Classification Search ..... 236/49.3, 236/44 C, DIG. 9; 62/176.6, 127, 176.1, 62/129; 318/471; 417/32, 45; 310/49 A, 310/67 R
See application file for complete search history.

(56) References Cited

U.S. PATENT DOCUMENTS 5,343,104 A * 8/1994 Takahashi et al. ..... 310/90
5,591,017 A 1/1997 Dwyer et al. ..... 417/366
6,013,966 A * 1/2000 Fehrenbacher et al. ..... 310/257
6,183,221 B1 * 2/2001 Hsieh ..... 417/423.12
6,619,556 B1 * 9/2003 Snider et al. ..... 236/49.3

FOREIGN PATENT DOCUMENTS

DE 41 40 505 A1 6/1992

(Continued)

OTHER PUBLICATIONS

Derwent English abstract of CAP/Papst-Motoren.
Espacenet English abstract of Bernauer + /Bosch.
Espacenet English abstract of Amrhein+/Papst-Motoren.
Espacenet English abstract of Bernhardt/Rittal-Werkrudolf LOH GmbH & Co. KG.
Espacenet English abstract of Mangler +/Bosch.

*Primary Examiner*—Chen-Wen Jiang
(74) *Attorney, Agent, or Firm*—Oliver Intellectual Property; Milton Oliver, Esq.

(57) ABSTRACT

A fan has a sensor (86; 186) for sensing at least one value of the air that flows through the fan (20; 120). The fan has a fan housing (22, 24; 122, 124); an electronically commutated external-rotor motor, arranged in that housing, having an internal stator (30; 130) and an external rotor (46; 146); a fan wheel (56; 156) coupled to the external rotor (46; 146); an air inlet opening (58; 90; 158) for the inflow of air that is to be moved by the fan wheel (56; 156); a circuit board (68; 185) having a portion (66; 188) that extends adjacent the air passage opening (58; 158); and conductors (82, 84; 182', 182") arranged on that portion (66; 188), to which conductors the sensor (86; 186) is connected, preferably by a Surface Mounted Device (SMD) method. Premounting the sensor on the circuit board facilitates automated manufacture and reduces cost.

22 Claims, 7 Drawing Sheets

FOREIGN PATENT DOCUMENTS

| | | | | |
|---|---|---|---|---|
| DE | 41 30 520 | A1 | | 3/1993 |
| DE | 195 03 521 | A1 | | 8/1995 |
| DE | 100 04 473 | A1 | | 8/2001 |
| DE | 100 21 067 | A1 | | 10/2001 |
| EP | 0 908 630 | A1 | | 4/1999 |
| KR | 2003056409 | A | * | 7/2003 |

* cited by examiner

FAN HAVING A SENSOR

FIELD OF THE INVENTION:

Sensor fans are used, for example, for air measurement for air-conditioning systems in motor vehicles. They have a diameter of, for example, 30 mm, i.e. these are what is referred to in technical language as "mini-fans."

BACKGROUND

Mini-fans of this kind contain an electronically commutated motor whose rotor drives a fan wheel. The latter takes in air through an air inlet opening, and that air is then blown out through one or more outlet openings, e.g. radial openings.

Arranged in the region of the air passage opening are one or more sensors, e.g. a Negative Temperature Coefficient (NTC) resistor at which the present air temperature is measured, or a sensor for the moisture content, quality, radioactivity, stuffiness, dustiness, etc. of the air. For example, air quality in a workplace could be maintained by keeping a particular gas or pollutant, such as carbon dioxide or methane or flammable fumes, below a predetermined threshold level. An air conditioning system, for example, can be controlled in accordance with data from such a sensor or sensors. Since the fan is so small, installation of such a sensor, e.g. an NTC resistor, as a discrete device, is difficult and also entails considerable cost. In addition, an electrical connection must be made from the sensor installation location to a connector of the fan, which results in additional labor and material costs.

SUMMARY OF THE INVENTION

It is therefore an object of the invention to provide a new fan structure which is compact and cost-effective to manufacture.

According to the invention, this object is achieved by providing a sensor on a circuit board which is mounted directly on the housing of the fan. The use of a circuit board substantially simplifies manufacture, since a sensor can be mounted on the circuit board using automatic production methods, e.g. as a Surface Mounted Device (SMD) component. This also makes it possible to miniaturize the fan further, since a sensor that is installed on a circuit board has only a very low overall height. The present invention thus enables the overall size of such a fan to be further reduced.

An advantageous embodiment of the invention is to make the circuit board bifurcated, with a hinge or bend between a sensor portion of the board and a commutation control portion of the board. The circuit board advantageously has a reduced thickness in the region of its bend, to increase its flexibility. That thickness can be reduced, for example, by at least 50%, preferably by 70 to 85%, compared to a remaining portion of the board.

It has proven very advantageous in this context to brace the circuit board, in particular in positively engaged fashion, in the region of its bend against a rounded or "bending" edge of the fan housing. This bending edge has important advantages:

It supports the circuit board during a bending operation and thereby prevents the circuit board from breaking during installation or mounting of the board onto the housing.

It supports and protects the circuit board during the entire service life of the fan, so that the thin portion of the circuit board, because it rests on the bending edge, is very well braced and thereby protected from mechanical damage.

BRIEF FIGURE DESCRIPTION

Further details and advantageous refinements of the invention are evident from the exemplary embodiment, in no way to be understood as a limitation of the invention, that is described below and shown in the drawings.

Figure 5:
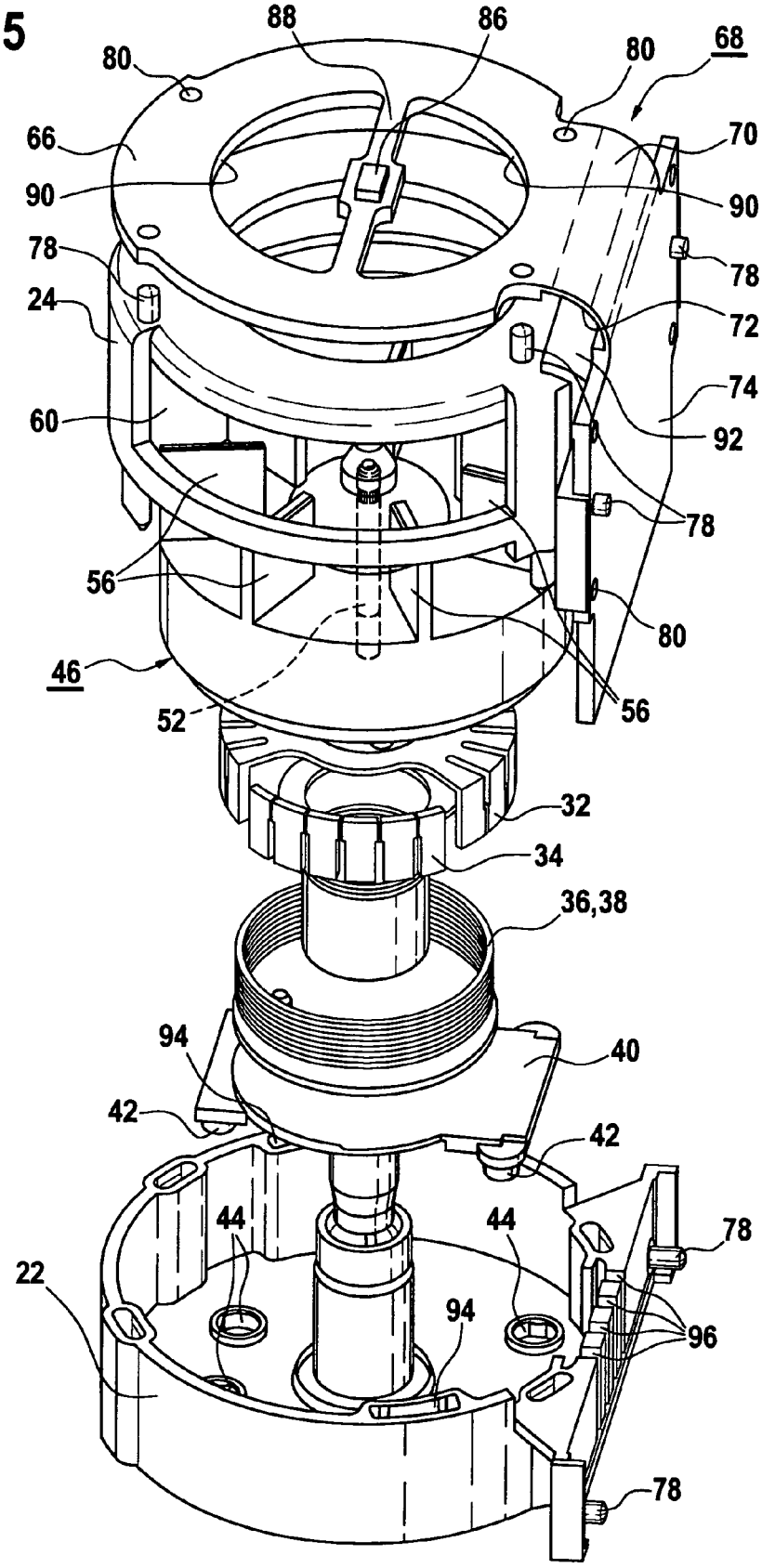
FIG. 5 is a greatly enlarged exploded view of the fan according to FIGS. 1 and 2.
Figure 6:
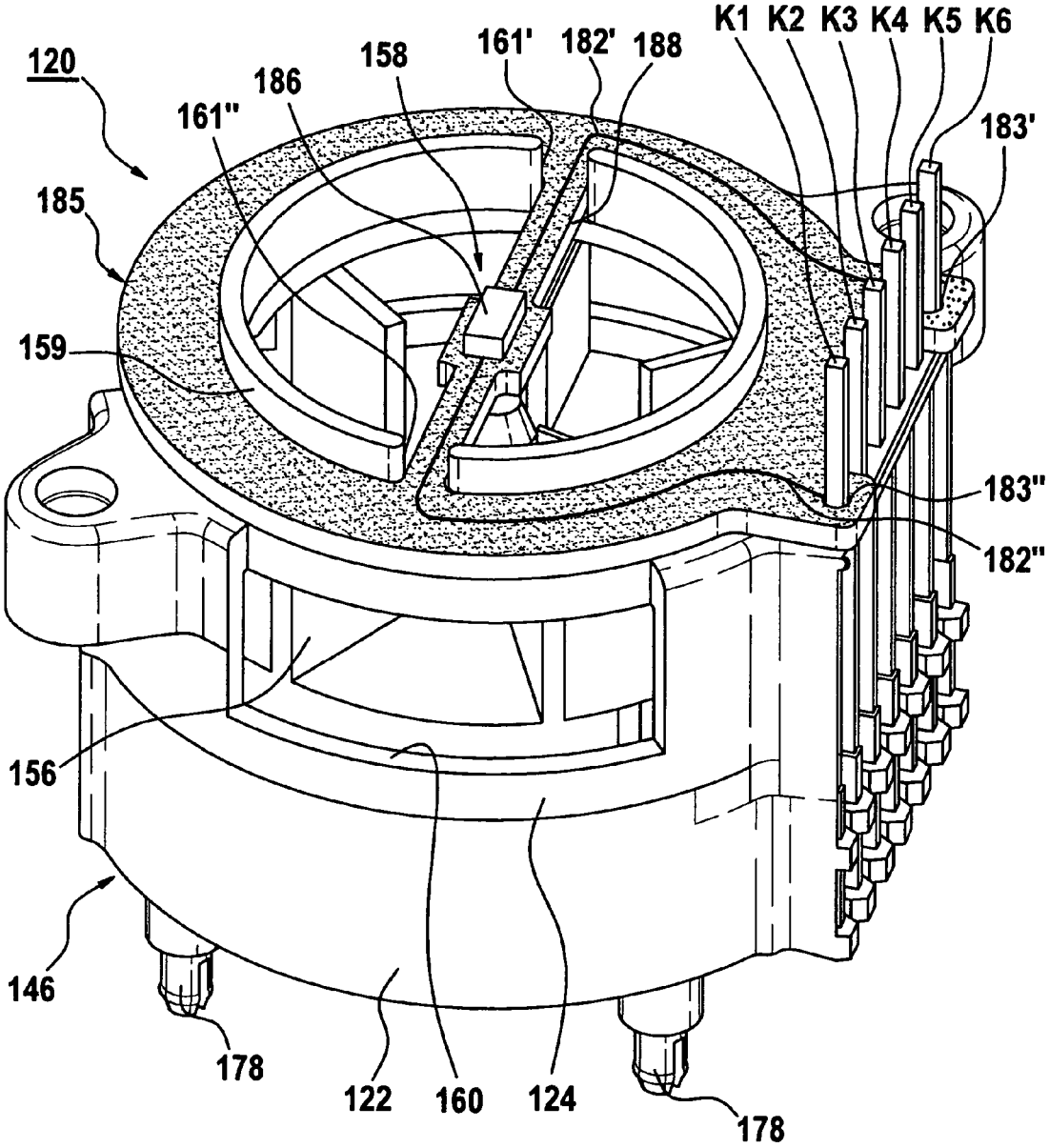
Figure 7:
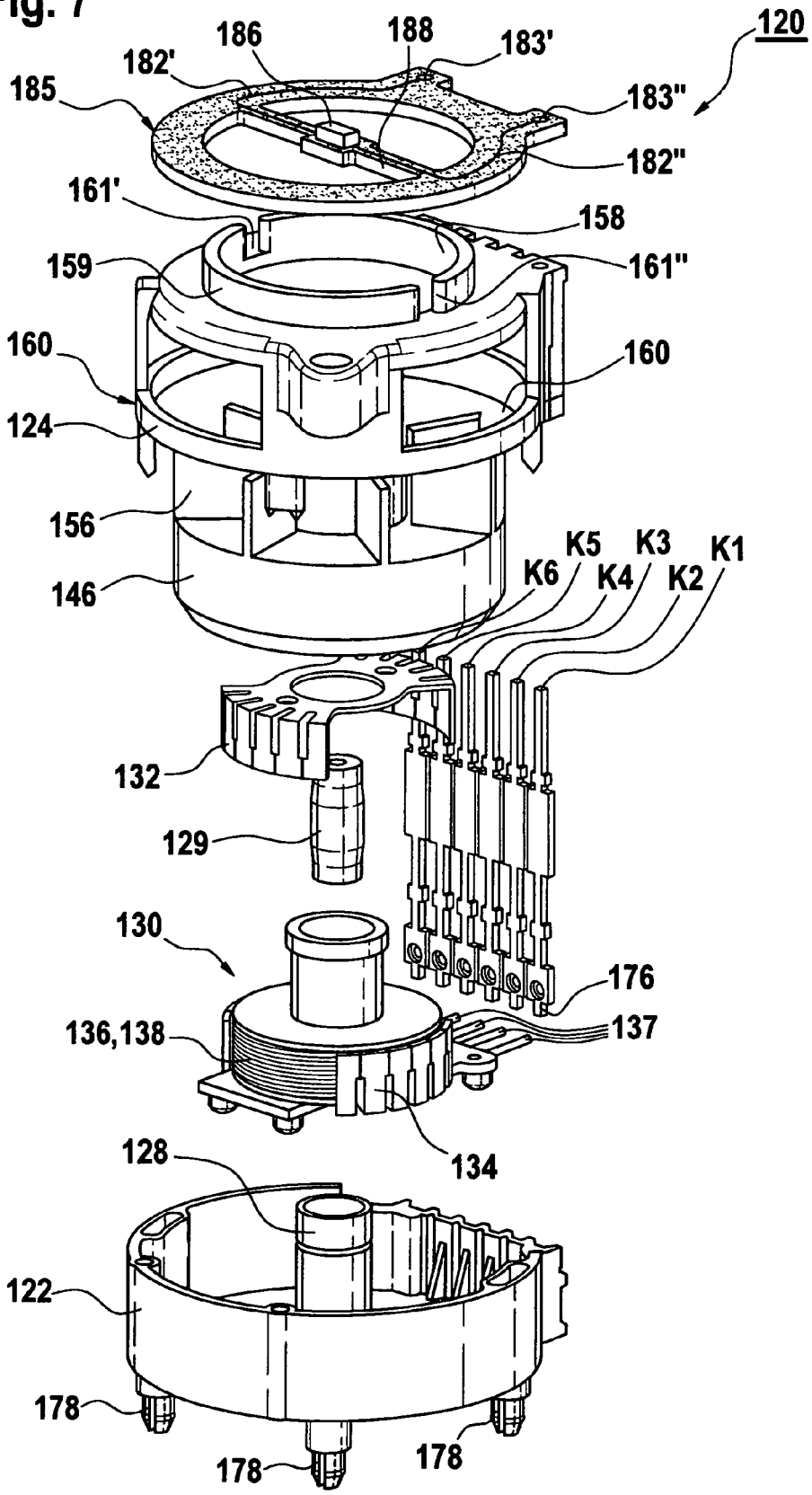

FIG. 6 is a variant of FIGS. 1 through 5 showing, in perspective, a fan in which an NTC resistor 186 is mounted on a separate circuit board 185; and FIG. 7 is an exploded view of the fan of FIG. 6.

DETAILED DESCRIPTION

Figure 1:
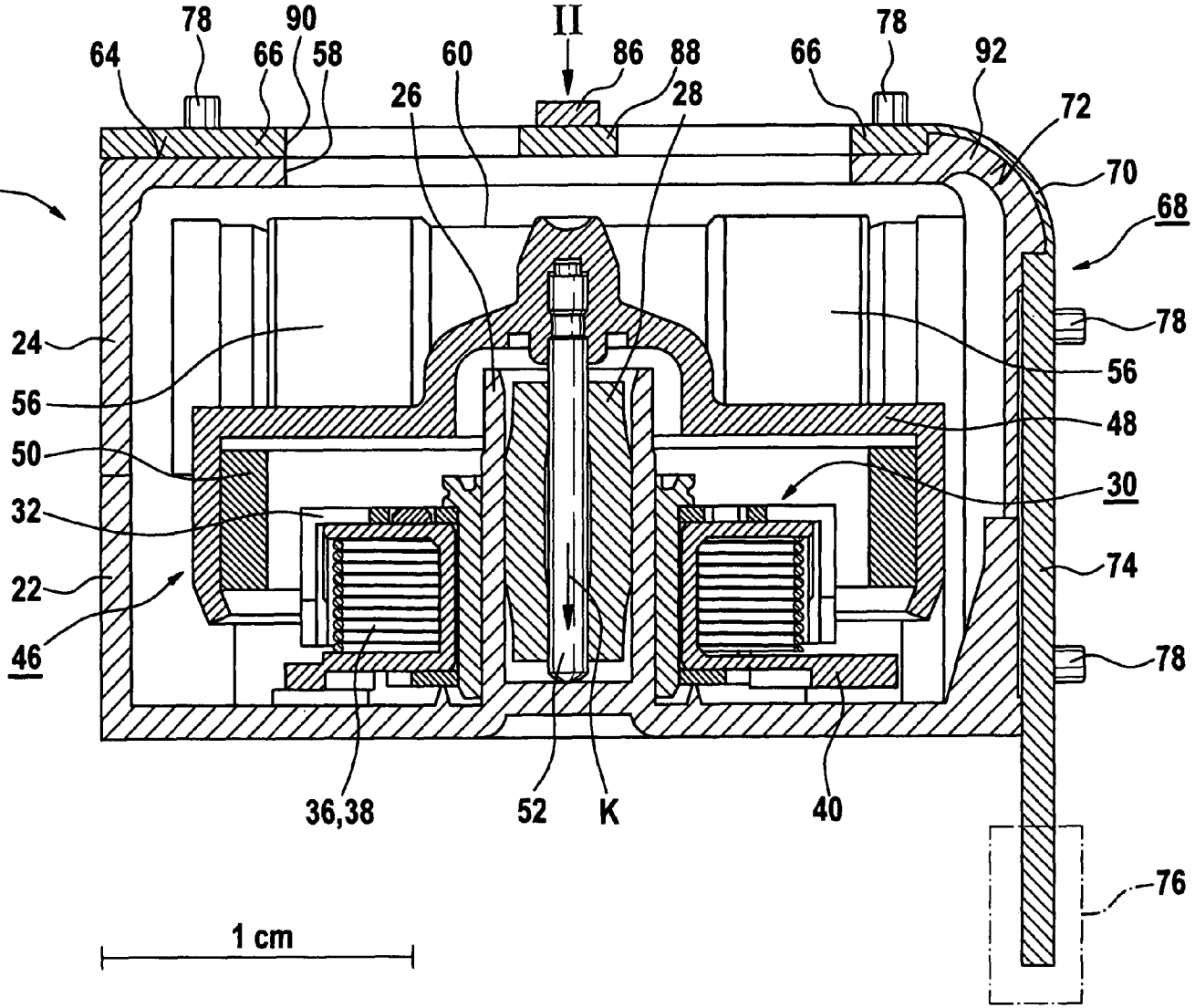
FIG. 1 is a very greatly enlarged longitudinal section through a preferred embodiment of a fan according to the present invention, viewed along line I-I of FIG. 2.
Figure 2:
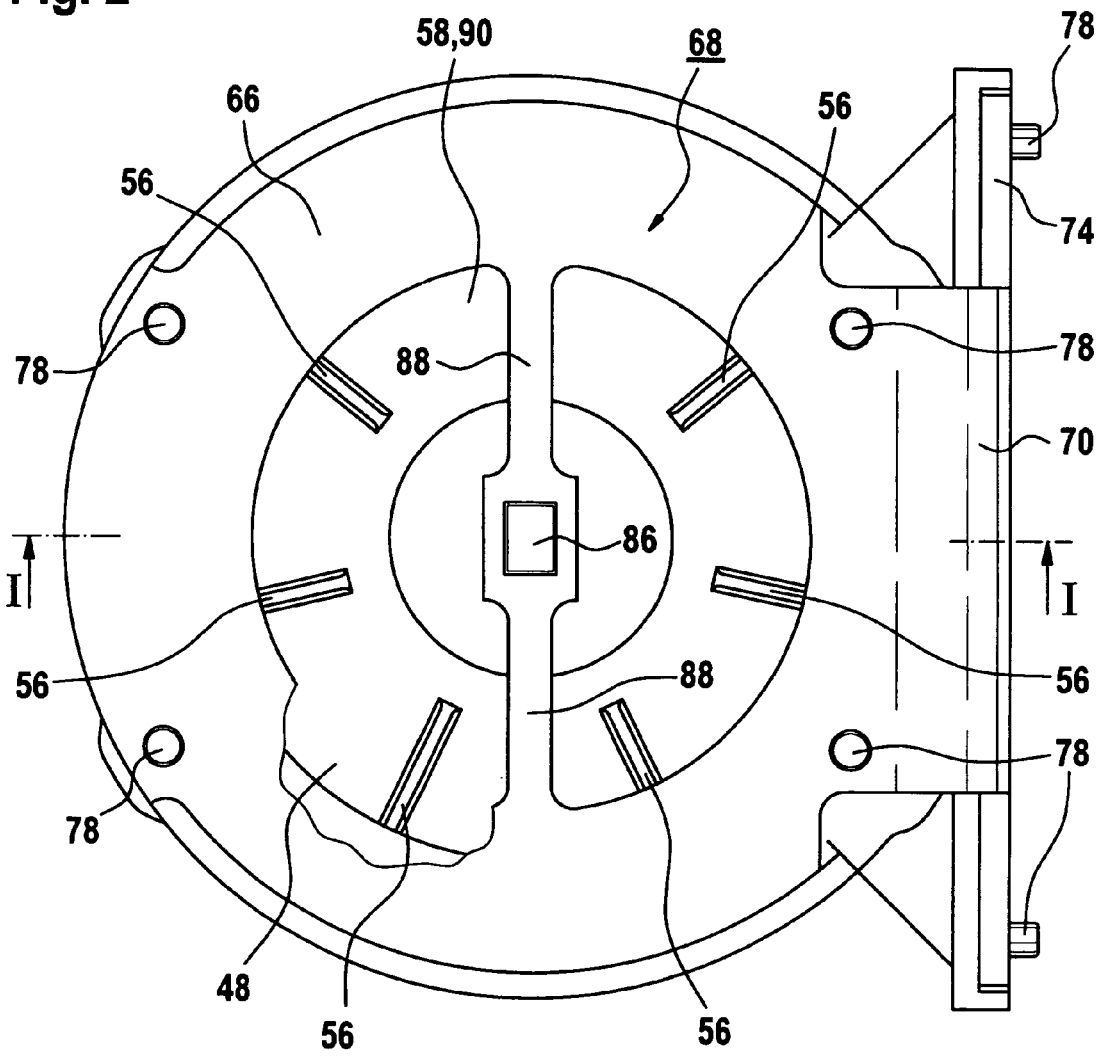
FIG. 2 is a plan view of the intake opening of the fan, viewed in the direction of arrow II of FIG. 1.
Figure 3:
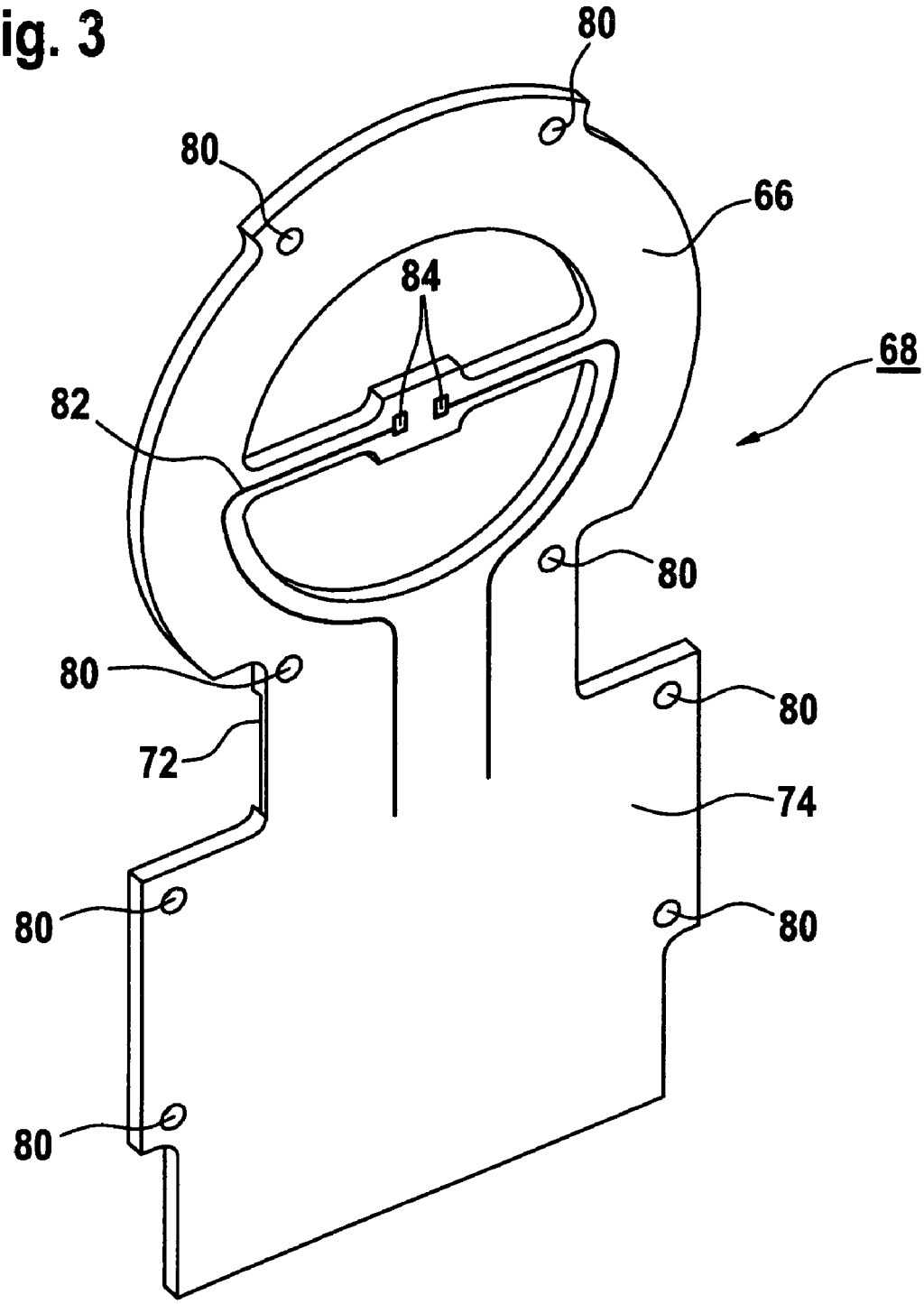
FIG. 3 is a three-dimensional depiction of a circuit board used in the context of FIGS. 1 and 2, in the state before it is bent.
Figure 4:
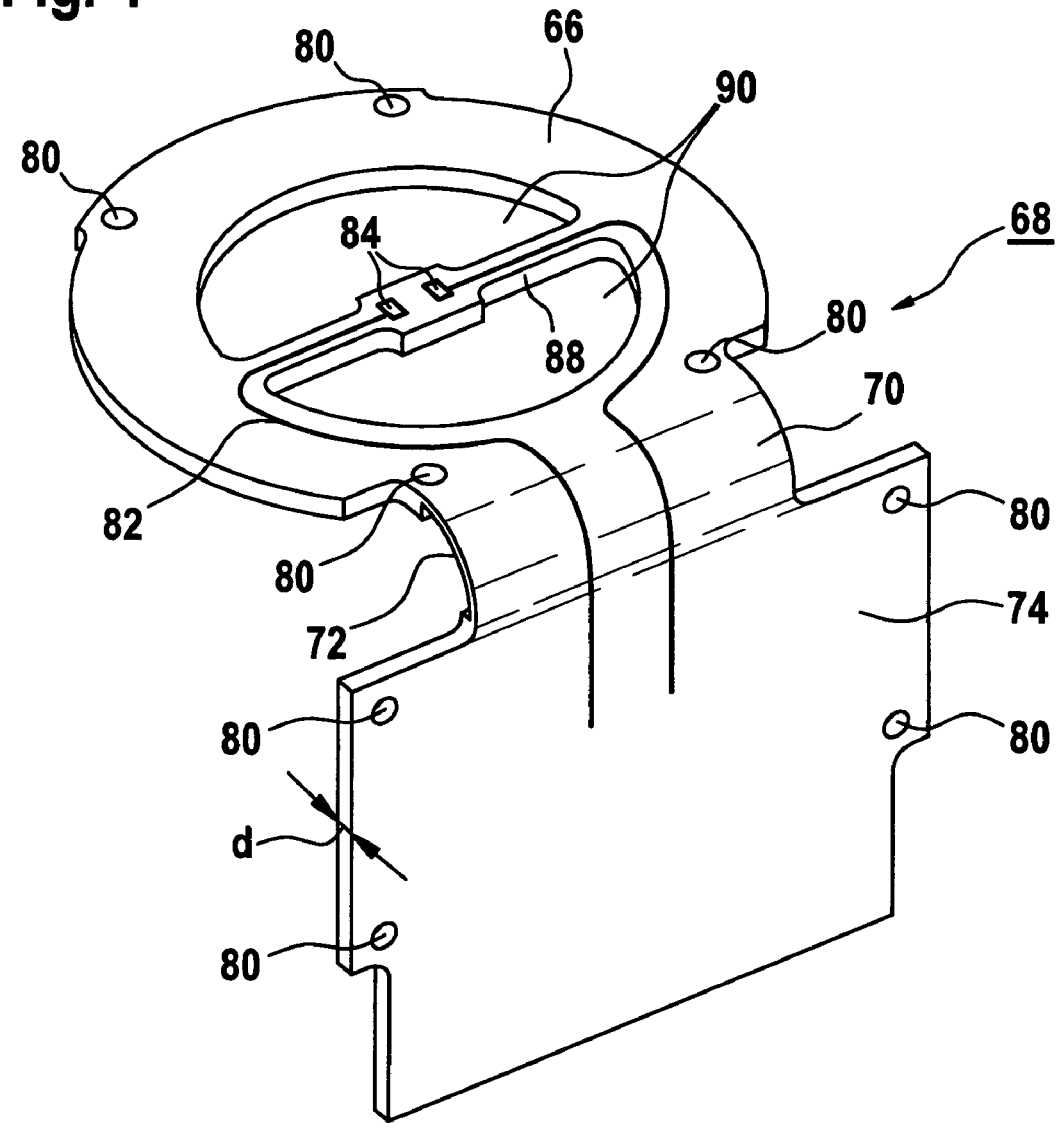
FIG. 4 shows the same circuit board in the bent state.

FIG. 1 shows a mini-fan 20. The latter has, for example, an outside diameter of 30 mm and a height of 20 mm, and is shown greatly enlarged, so that details can be depicted with sufficiently accuracy. FIG. 1 shows, by way of example, an indication of scale, in order to illustrate size relationships.

Fan 20 has a lower housing part 22 and an upper housing part 24 joined mechanically thereto. Lower housing part 22 has in the center a bearing support tube 26, into which a sintered bearing 28 is pressed and on whose outer side is mounted an internal stator 30 that here, as shown in FIG. 5, comprises claw poles 32, 34 including two annular coils 36, 38 (indicated only schematically) that are preinstalled on a carrier 40. Annular coil 36 serves to drive the motor, and annular coil 38 as a so-called sensor coil for sensing the rotor position for electronic commutation. Carrier 40 has four pegs 42, with which it is pressed into corresponding holes 44 of lower housing part 22, as shown in FIG. 5.

Also provided is an external rotor 46 that has a rotor cup 48 within which is arranged an annular permanent magnet 50, which here is magnetized with four poles, since the claw-pole stator shown also has four poles.

Mounted in rotor cup 48 is a shaft 52 that, as shown, is supported in sintered bearing 28 and is in contact with its free end against lower housing part 22. Since rotor magnet 50 in FIG. 1 is offset axially upward with respect to claw poles 32, 34, a force K acts on rotor 46 in the direction toward lower housing part 22, and presses shaft 52 against the latter (axial plain bearing with axial preload).

Fan blades 56 of a radial fan are arranged on rotor cup 48. These blades draw air through an axial air passage inlet opening 58 in upper housing part 24, and blow that air back out radially through lateral openings 60. FIG. 5 shows one of the two lateral openings 60.

Upper housing part 24 has a flat upper side 64, and mounted thereon is a first portion 66 of a circuit board 68 whose shape is clearly evident from FIGS. 1 through 5. This circuit board 68 has in general a thickness d of approximately 1 mm, which is reduced to approximately 0.22 mm by a milled recess 72 in a bending region 70, in order to facilitate easier bending there. It has been shown that this makes possible a bend whose bending angle can be between 0° and approximately 180°. Circuit board 68 has, below bending region 70, a second portion 54 on which are arranged other electronic components of fan 20, e.g. those which control commutation. According to FIG. 1, a plug connector 76 of arbitrary design is mounted at the bottom of second portion 74, in order to allow easy installation.

Serving to mount circuit board 68 are pegs 78 made of plastic, which are provided on housing parts 22, 24. The pegs project through openings 80 in circuit board 68, and are permanently secured there e.g. by heating or other types of positively engaged connection. Also located on circuit board 68 are printed conductors 82 that lead to contact surfaces 84 on which a sensor (here an NTC resistor 86) is soldered in place using a Surface Mounted Device (SMD) method. Such NTC resistors are well known in the art. A resistor 86 of this kind has a very low overall height while functioning normally.

Contact surfaces 84 are located on a thin strut 88 that extends in portion 66 approximately diametrically with respect to an opening 90 in board 68 whose shape matches that of air inlet passage 58 formed in housing part 24.

A rounded support surface 92, whose shape is best evident from FIG. 1, is provided in the region of bend 70 on housing part 24. When circuit board 68 is bent, support surface 92 fits (preferably in positively engaged fashion) into milled recess 72, therefore optimally braces circuit board 68 in the region of its bend 70, and at the same time forms bend 70 so that conductors 82 do not become cracked there. The thickness of the copper layer that forms conductors 82 is advantageously selected to be sufficient, especially in the region of bend 70, to exploit the ductility of copper.

Provided in lower housing part 22 are two diametrically opposite pockets 94 (FIG. 5) in which are arranged positioning magnets (not shown) which, when the motor is currentless, rotate rotor 46 into a predetermined rotational position, from which starting in the correct rotation direction can occur without difficulty.

The connectors of coils 36, 38 are connected to corresponding conductors (not shown) of circuit board 68. Lower housing part 22 has four slots 96 (see FIG. 5) for that purpose.

FIGS. 6 and 7 show a second exemplary embodiment of the sensor fan 120 of the present invention. It has a fan wheel 156 that is driven by an electronically commutated motor. It furthermore has a lower housing part 122 and an upper housing part 124 connected thereto. The latter is formed on its upper (in FIG. 6) side with an air passage opening 158, which is defined by a cylindrical collar 159 and into which air flows from above during operation. Collar 159 has two lateral gaps or orifices 161' and 161".

The motor has an internal stator 130 that here has claw poles 132, 134 and two annular coils 136, 138. An external rotor 146 has a rotor cup 148 (not clearly shown, but similar to rotor cup 48 of the first embodiment) within which an annular magnet is arranged. Mounted in rotor cup 148 is a shaft that is supported in a sintered bearing 129 that is arranged in a bearing support tube 128.

Located laterally on housing parts 122, 124 is a contact array comprising six contacts K1 through K6 that transition at the bottom into solder lugs 176 which serve, for example, for connection to conductors (not depicted) of a circuit board. Housing 120, 124 is provided with resilient mounting pegs 178.

Contact array K1 through K6 is immovably joined to housing parts 122, 124 e.g. by plastic welding. Its contacts K2 through K5 serve for connection to four connecting pins 137 of the two stator coils 136, 138. Its contacts K1 and K6 serve for connection to two connecting leads of an NTC sensor 186 that is located approximately at the center of inlet opening 158 in order to measure the temperature of the inflowing air there.

Rotor 146 is coupled directly to the blades of fan wheel 156. NTC sensor 186 is mounted on a transverse strut 188 of a generally annular circuit board 185 using SMD technology, and electrically connected there to two conductors 182', 182" that lead to contact holes 183' and 183", respectively. These contact holes are soldered directly to contacts K6 and K1, respectively, of the contact array. NTC sensor 186 is thereby electrically connected, and the annular circuit board 185, a component of which is strut 188 that runs diagonally with respect to that annular circuit board 185, is mechanically mounted on sensor fan 120 by the soldering operation.

The advantage resulting from this is that circuit board 185 can easily be replaced or swapped out, in the event that it becomes damaged. It is also possible to use the same sensor fan 120 for NTC resistors 186 having different resistance values, only circuit board 185 being different. Because annular circuit board 185 is located outside collar 159, it does not impede the inward flow of air through opening 158, and strut 188 likewise does not constitute a substantial obstacle to that air flow.

The air outlet openings are labeled 160 in FIGS. 6 and 7.

Many variants and modifications are, of course, possible within the scope of the present invention. Therefore, the invention is not limited to the specific embodiments shown and described, but rather is defined by the following claims.

What is claimed is:

1. A fan having at least one sensor (86; 186) for sensing at least one value of the air that flows through the fan (20; 120), said fan comprising:

a fan housing (22, 24; 122, 124) having an air inlet opening (58; 158) and an air outlet opening (60; 160);

an electronically commutated external-rotor motor, arranged in that fan housing (22, 24; 122, 124), which motor has an internal stator (30; 130) and an external rotor (46; 146);

a fan wheel (56; 156) coupled to the external rotor (46; 146), serving to pull air in through said air inlet opening (58; 158) and to exhaust said air through said air outlet opening (60; 160);

a circuit board having a first portion (66, 88; 188) and having conductors (82, 84: 182', 182") arranged on that first portion, said first portion (66, 88; 188) having an outer portion (66; 185) located outside of the air inlet opening and a support part (88; 188) extending from the outer portion (66; 185) into the region of the air inlet opening (58; 158), said conductors (82, 84; 182', 182") extending from the outer portion to the support part (88; 188) and said sensor (86; 186) being supported by said support part (88; 188) and being connected to the conductors (82,84; 182', 182").

2. The fan according to claim 1, wherein said sensor is a Surface Mounted Device (SMD) sensor and is connected to said conductors by a Surface Mounted Device (SMD) method.

3. The fan according to claim 1, wherein said sensor senses a value of the air selected from the group consisting of temperature, humidity, radioactivity, and air quality.

4. The fan according to claim 1, wherein the circuit board (68; 185) is retained on the fan housing (22, 24; 122, 124).

5. The fan according to claim 1, wherein the first portion (66) of the circuit board (68) is equipped with at least one air passage opening (90).

6. The fan according to claim 1, wherein there is implemented integrally with the fan housing (22, 24; 122, 124) a bearing support tube (26; 128) in which a bearing arrangement (28; 129) is provided for supporting a shaft (52) of the external rotor (46; 146).

7. The fan according to claim 1, wherein the sensor is implemented as a Negative Temperature Coefficient (NTC) resistor (86; 186).

8. The fan according to claim 1, wherein the sensor (86; 186) is implemented for temperature sensing for an air-conditioning system.

9. The fan according to claim 1, wherein a contact array (K1-K6) is provided; and the circuit board (185) is electrically and mechanically connected to elements (K1, K6) of that contact array.

10. The fan according to claim 1, wherein the fan is a radial fan.

11. A fan having at least one sensor (86; 186) for sensing at least one value of the air that flows through the fan (20; 120), said fan comprising:

a fan housing (22, 24; 122, 124) having an air inlet opening (58; 158) and an air outlet opening (60; 160);

an electronically commutated external-rotor motor, arranged in that fan housing (22, 24; 122, 124), which motor has an internal stator (30; 130) and an external rotor (46; 146);

a fan wheel (56; 156) coupled to the external rotor (46; 146), serving to pull air in through said air inlet opening (58; 158) and to exhaust said air through said air outlet opening (60; 160);

a circuit board having a first portion (66, 88; 188) and having conductors (82, 84: 182', 182") arranged on that first portion, said first portion (66,88; 188) having an outer portion (66; 185) located outside of the air inlet opening and a support part(88; 188) extending from the outer portion (66; 185) into the region of the air inlet opening (58; 158), said conductors (82,84; 182', 182") extending from the outer portion to the support part (88; 188) and said sensor (86; 186) being supported by said support part (88; 188) and being connected to the conductors (82,84; 182', 182"), wherein there is provided, in the region of the air inlet opening (158), a collar (159) through which the first portion (188) of the circuit board (185) extends into the air inlet opening (158).

12. The fan according to claim 11, wherein the fan is a radial fan.

13. A fan having at least one sensor (86; 186) for sensing at least one value of the air that flows through the fan (20; 120), said fan comprising:

a fan housing (22, 24; 122, 124) having an air inlet opening (58; 158) and an air outlet opening (60; 160);

an electronically commutated external-rotor motor, arranged in that fan housing (22, 24; 122, 124), which motor has an internal stator (30; 130) having at least one stator coil (136, 138) and an external rotor (46; 146);

an air passage opening (58; 90; 158) for passage of air that is to be moved by a wheel (56; 156) of the fan;

a first circuit board (68; 185) having a first portion (66, 88; 188) that extends in a region of the air passage opening (58; 158), said first portion comprising conductors and contact holes (183', 183"), the sensor (86; 186) being connected to the conductors, said conductors leading to the contact holes (183', 183");

a contact array located on the fan housing and including a plurality of contacts (K1-K6) which transition, at free ends thereof, into solder lugs (176) adapted for connection to conductors of a second circuit board, part of said plurality of contacts being connected electrically to said at least one stator coil (136, 138), others of said contacts being directly soldered to the contact holes and being connected electrically to said conductors (82, 84; 182', 182") arranged on said first portion (66, 88; 188) for electrically connecting said sensor (86; 186) to solder lugs (176) associated with said sensor (86; 186).

14. The fan of claim 13, wherein said sensor is a Surface Mounted Device (SMD) sensor and is connected to said conductors by a Surface Mounted Device (SMD) method.

15. The fan of claim 13, wherein said sensor is adapted to sense a parameter of the air selected from the group consisting of temperature, humidity, radioactivity, and air quality.

16. The fan of claim 13, wherein said first circuit board (68; 185) is mounted on the fan housing (22, 24; 122, 124).

17. The fan of claim 13, wherein said first portion (66) of the first circuit board (68) is formed with at least one air passage opening (90).

18. The fan of claim 17, wherein a support part (88, 188) of the first circuit board (88; 188) extends into the air passage opening (90; 158), and the sensor (86; 186) is arranged on said support part.

19. The fan of claim 13, wherein the sensor is implemented as a Negative Temperature Coefficient (NTC) resistor.

20. The fan of claim 13, wherein the sensor is implemented for temperature sensing for an air conditioning system.

21. The fan of claim 13, wherein the first circuit board (185) is electrically and mechanically connected to elements (K1, K6) of the contact array.

22. The fan according to claim 18, wherein the fan is a radial fan.

* * * * *